US006065960A

United States Patent [19]

Hardy

[11] Patent Number: 6,065,960

[45] Date of Patent: May 23, 2000

[54] LAYERED GLASS CANDLE HOLDER

[75] Inventor: Christopher Hardy, Springfield, Ill.

[73] Assignee: Design Ideas, Ltd., Springfield, Ill.

[21] Appl. No.: 08/573,563

[22] Filed: Dec. 15, 1995

[51] Int. Cl.[7] ..... F23D 3/16

[52] U.S. Cl. ..... 431/294; 431/292; 431/288

[58] Field of Search ..... 431/291, 125, 431/288, 292, 295, 126

[56] References Cited

U.S. PATENT DOCUMENTS

| | | | |
|---|---|---|---|
| D. 190,358 | 5/1961 | Scheuerlein | D85/2 |
| D. 236,577 | 9/1975 | Press | D7/264 |
| D. 269,638 | 7/1983 | Frye, Jr. et al. | D26/9 |
| D. 301,749 | 6/1989 | Comstock | D26/9 |
| D. 312,028 | 11/1990 | Pinette, Jr. | D7/624 |
| D. 340,002 | 10/1993 | Smith, Sr. | D26/9 |
| 1,237,670 | 8/1917 | Melville | 431/295 |
| 1,981,627 | 11/1934 | Merriman | D7/624 |
| 2,104,139 | 1/1938 | Sherwood | 431/295 |
| 2,795,124 | 6/1957 | Bruce | 431/295 |
| 2,811,030 | 10/1957 | Tannahill | 431/292 |
| 2,987,901 | 6/1961 | Coffey | 431/289 |
| 3,315,497 | 4/1967 | McDonald | 431/125 X |
| 3,493,315 | 2/1970 | Nissen | 431/295 |
| 3,706,523 | 12/1972 | Kumm | 431/288 X |
| 3,743,473 | 7/1973 | Von Suskil | 431/289 X |
| 3,932,113 | 1/1976 | Thrush | 431/289 |
| 4,336,574 | 6/1982 | Goodman | D7/624 |
| 4,818,215 | 4/1989 | Taga | 431/291 X |

FOREIGN PATENT DOCUMENTS

| | | | |
|---|---|---|---|
| 493494 | 10/1938 | United Kingdom | 431/295 |

*Primary Examiner*—Larry Jones
*Attorney, Agent, or Firm*—Saidman DesignLaw Group

[57] ABSTRACT

A candle holder comprising a plurality of layers of stacked glass. The layers may be of any desired thickness, or varying thicknesses, and may also be any desired color. The layers have an aperture for accommodating a candle therewithin, and preferably include positioning grooves for aligning the layers. By mixing and matching the various layers, different unique and pleasing ornamental effects may be achieved.

19 Claims, 3 Drawing Sheets

LAYERED GLASS CANDLE HOLDER

BACKGROUND OF THE INVENTION

1. Field of the Invention

This invention relates to candle holders and, more particularly, is directed towards a candle holder which comprises a plurality of components that may be moved and rearranged with respect to each other, and which therefore can form unique and pleasing ornamental displays.

2. Description of Related Art

Candle holder units which stack on one another are well-known. See, for example, U.S. Pat. No. 3,932,113 to Thrush and U.S. Pat. No. 3,743,473 to Von Suskil. However, each of these patents are directed to candle holders which are unitary pieces that may be used either individually or may be stacked one on top of the other, as may be desired.

It is also known in the art to provide a candle holder which is capable of changing color. See, for example, U.S. Pat. No. 4,818,215 to Taga.

While each of the above-noted designs may be individually commendable, they are limited in that each individual candle holder is an integral, formed unit which itself, therefore, is not capable of modification, except perhaps as to overall color.

It therefore may be appreciated that it would be highly desirable if a candle holder could be provided in which the user could customize the appearance of the candle holder by selecting components thereof that may be of a different color, different shape, and/or different size, thereby resulting in a distinctive candle holder that may be "custom built" by the user for each use.

It is towards achieving this general object that the present invention is advanced.

OBJECTS AND SUMMARY OF THE INVENTION

It is therefore a primary object of the present invention to provide a unique and distinctive candle holder which enables the user to create any of a number of aesthetically pleasing yet different candle holders.

Another object of the present invention is to provide a candle holder which consists of a number of different elements that may be combined by a user in any of a number of different configurations to create unique and pleasing ornamental appearances.

A further object of the present invention is to provide a novel candle holder structure which consists of a number of movable, interchangeable and differently colored and/or shaped elements, whereby the user may pick and choose elements in a particular order or fashion to create her own unique candle holder.

The foregoing and other objects are achieved in accordance with one aspect of the present invention through the provision of a candle holder which comprises a base having means for holding a candle, and a plurality of layers of glass stacked on the base, each of the layers including an aperture formed therein for accommodating the candle therewithin. In one embodiment, the layers of glass have substantially the same peripheral shape, while alternatively, the layers of glass may have different peripheral shapes. In one embodiment, the outer periphery of the layers of glass is square, while in an alternate embodiment, the outer periphery is oval.

In accordance with another aspect of the present invention, the layers of glass may be of more than one thickness. Further, the layers of glass may comprise more than one color. In a preferred embodiment, the plurality of layers of glass each are of a color selected from the group consisting of clear white, frosted white, clear blue, frosted blue and cobalt blue, although it should be understood that other colors are within the scope of the present invention.

In accordance with another aspect of the present invention, each of the outer layers of glass further comprises means for positioning each layer on top of and below another layer. The positioning means in one embodiment comprises a ridge formed on an outer surface of each of the layers, and a groove formed on the other outer surface of each layer. In an alternate embodiment, the positioning means may comprise a ball formed on one surface of each layer, and a socket formed on the other outer surface of each layer.

In accordance with other aspects of the present invention, the base has an outline similar to the outline of the plurality of layers, and further includes layer positioning means formed thereon for receiving one of the layers on top thereof. The means for holding a candle preferably comprises a solid portion for the base, the apertures of the plurality of layers being positioned over the solid bottom portion of the base during use.

In accordance with another aspect of the present invention, there is provided a holder for a single candle, which comprises a base member made of glass and having a central portion adapted to hold a candle therein, and a plurality of individual, movable glass layers stacked on top of the base member, the plurality of glass layers including layers of different colors. In accordance with a further aspect of the invention, the plurality of glass layers may include layers of different thicknesses and/or different peripheral shapes.

Finally, the present invention provides a holder for a candle which comprises a base member having a central portion adapted to hold a candle therein, and a plurality of glass layers stacked on top of the base member, the plurality of glass layers including layers of different thicknesses, each of the layers including a central aperture for fitting about the candle. The layers of different thicknesses may also comprise different colors.

BRIEF DESCRIPTION OF THE DRAWINGS

The foregoing and other objects, aspects and features of the present invention will be more fully appreciated as the same becomes better understood when considered in connection with the following detailed description of the present invention viewed in conjunction with the accompanying drawings, in which.

DETAILED DESCRIPTION OF THE PREFERRED EMBODIMENTS

Figure 1:
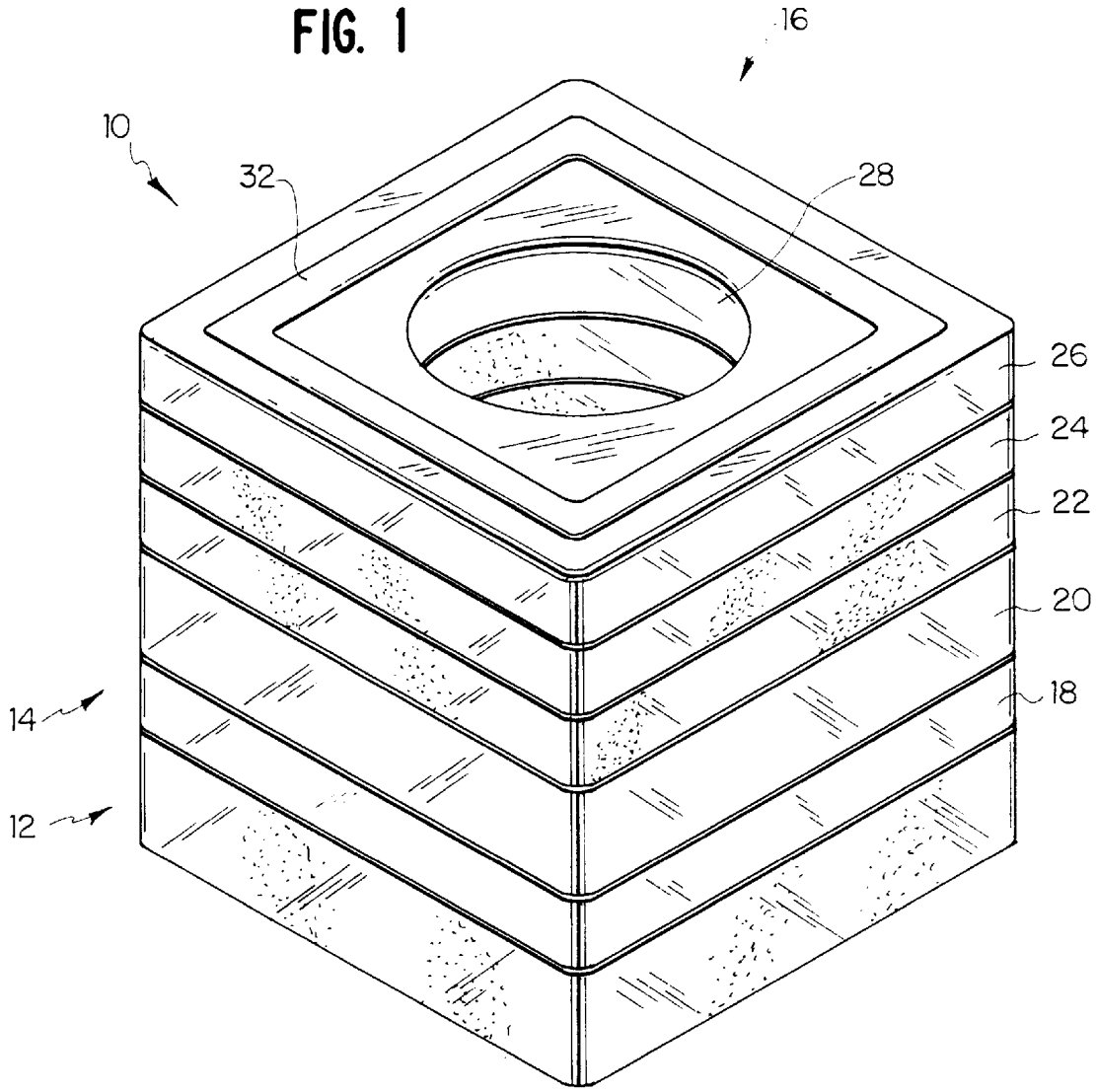
FIG. 1 is a perspective view of a preferred embodiment of the candle holder of the present invention.

Referring now to the drawings, wherein like reference numerals represent identical or corresponding parts throughout the several views, and more particularly to FIG. 1 thereof, reference numeral 10 indicates generally a single candle holder in accordance with the present invention. Candle holder 10 broadly includes a base 12 on top of which rests a body portion indicated generally by reference numeral 14. Body portion 14 is characterized by having a hole or aperture, indicated generally by reference numeral 16, extending downwardly therethrough to base 12. Aperture 16 is adapted to receive a candle, such as a votive candle.

In accordance with the present invention, body portion 14 comprises a plurality of individual layers of glass which are stacked one on top of the other in any order or number as may be desired by the user. The five individual layers of glass in the illustrated embodiment are indicated by reference numerals 18, 20, 22, 24 and 26. Bottom layer 18 rests on base 12 which differs from the other glass layers in a manner that will be described in greater detail hereinafter.

A unique, aesthetically pleasing edge-lighting effect occurs by virtue of the provision of a plurality of individual layers of glass that form body portion 14. Further, this unique edge lighting effect may be varied by the user depending upon the shape, color, and thickness of the individual layers 14.

For example, in the embodiment shown in FIG. 1, each layer 18–26 of body portion 14 is similar in peripheral shape (i.e., square); however, the thicknesses of the layers may vary. For example, layers 18, 22, 24 and 26 are of a first thickness, while layer 20 is of a second, thicker thickness. Obviously, more than two thicknesses may be employed, if desired, and the different layers may be arranged by the user in any desired manner. Each different combination of layers of differing thicknesses has the potential to create a distinct and unique overall ornamental appearance.

Figure 3:
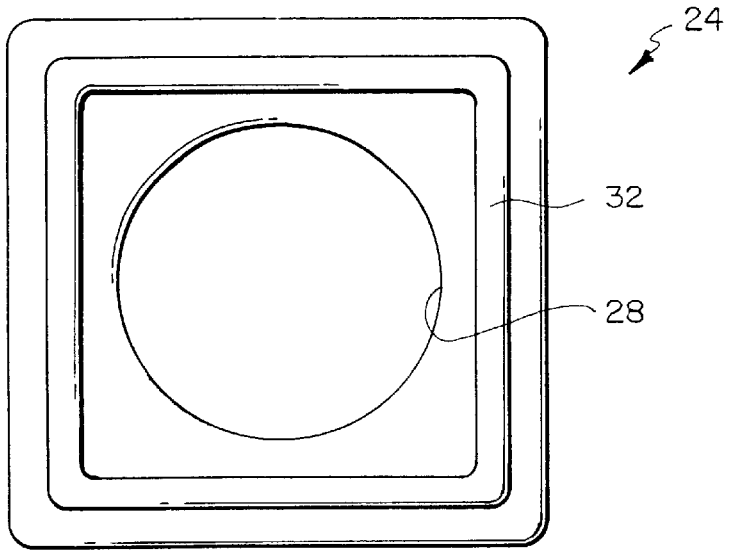
FIG. 3 is a plan view of one component of the preferred embodiment of FIG. 1.
Figure 2:
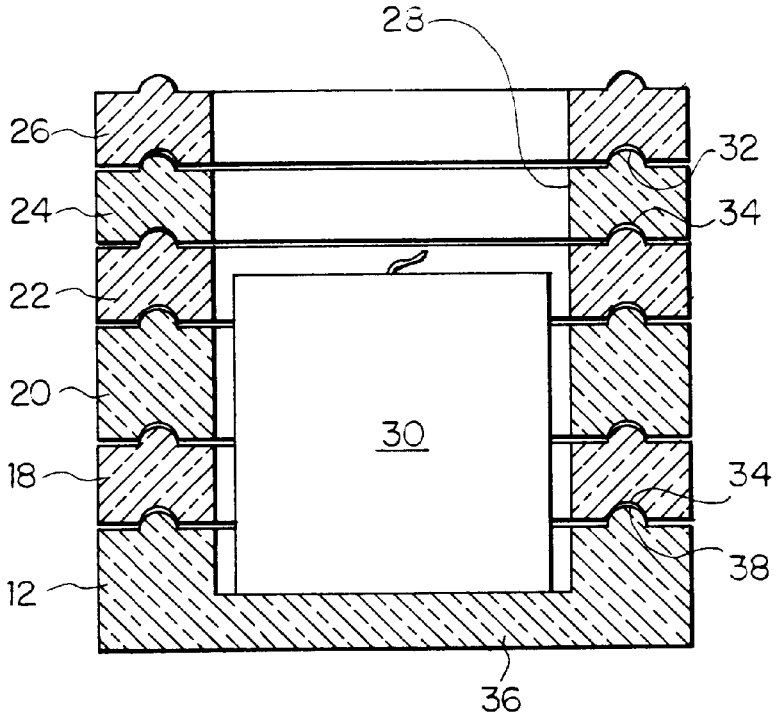
FIG. 2 is a vertical sectional view of the preferred embodiment of FIG. 1.

As seen in FIG. 3, typical layer 24 includes a central aperture 28 which is sized to receive a suitable candle, e.g., votive candle 30 (FIG. 2). As is apparent from FIG. 2, central aperture 28 is preferably larger than candle 30 so that candle 30 does not touch aperture 28.

Each layer also preferably includes means for positioning it within the overall stack of glass layers. For example, layer 24 may be provided with a ridge 32 on its top surface that fits within a similarly-positioned and complimentary groove 34 formed in the bottom surface of the adjacent layer. This is clearly shown in FIG. 2 which shows how the ridges and grooves 32 and 34 interfit so as to stabilize the overall candle holder.

Still with reference to FIG. 2, base 12 includes a bottom surface 36 which acts as a floor to support candle 30. Base 12 includes a peripheral ridge 38 so that groove 34 of layer 18 (or the groove 34 of any other layer) may be positioned thereon.

It may be appreciated from the foregoing that one feature of the present invention is that the user may select the number and order of layers desired to "custom build" her candle holder. The candle-holder may be built with as few as one or two layers, or really as many as may be desired. The ornamental effect is also variable by varying the thickness of each layer, as well as by varying the order in which the various layers are stacked.

In the preferred embodiment of the present invention, each of the individual layers forming body portion 14 are integral pieces, separate and individually removable and stackable. In an alternate embodiment, the present invention may be provided with the layers 18–26 being glued to each other, forming a unitary, immobile body portion 14. In such an embodiment, of course, the interchangeability feature of the first embodiment is not present. However, the unique, pleasing edge-lighting effect remains, such that a candle holder constructed according to this embodiment would nevertheless differ greatly in ornamental appearance from an ordinary, unitary, single-piece candle holder.

Another important feature of the present invention is that the individual layers 18–26 of body portion 14, as well base 12, may be provided in various different colors of glass. For example, layer 18 may consist of clear blue glass, layer 20 may consist of clear white glass, layer 22 may consist of cobalt blue glass (as may base 12), layer 24 may consist of frosted blue glass, while layer 26 may consist of clear white glass. This arrangement is illustrated in FIG. 8. Of course, other colors of glass may be used within the scope of the present invention.

Figure 4:
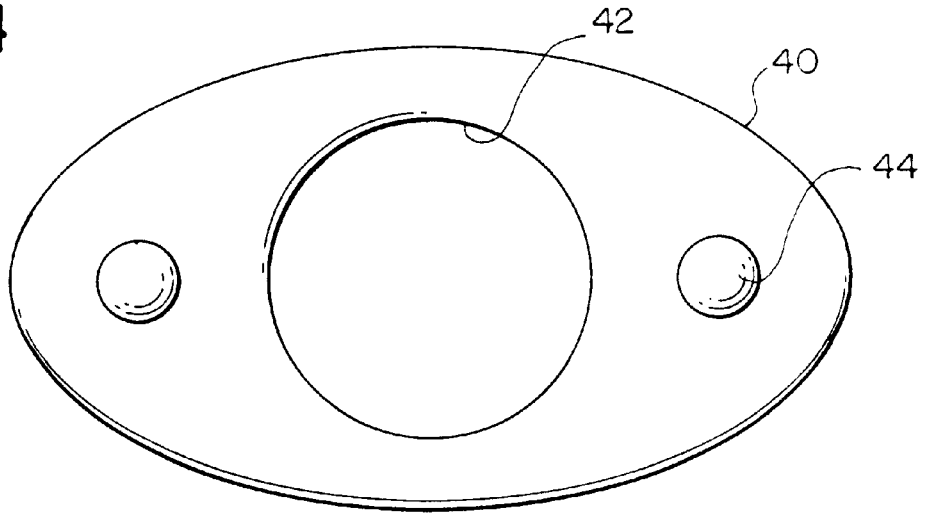
FIG. 4 is a plan view of an alternate embodiment of the present invention.
Figure 5:
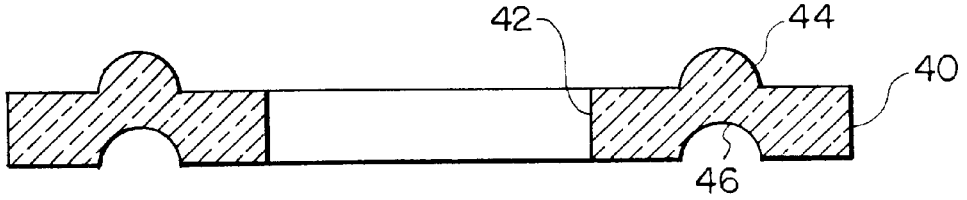
FIG. 5 is a vertical sectional view of the component of FIG. 4.

While layers 18–26 of FIGS. 1–3 have a square peripheral shape, other shapes of glass layers may be employed within the scope of the present invention. For example, FIGS. 4 and 5 illustrate a glass layer which has an oval shape 40. In the middle of oval layer 40 is an aperture 42 to receive the votive candle. In lieu of grooves and ridges, oval layer 40 may be provided with a pair of balls 44 on its upper surface intended to mate with a pair of sockets 46 similarly positioned on the adjacent layer.

Figure 6:
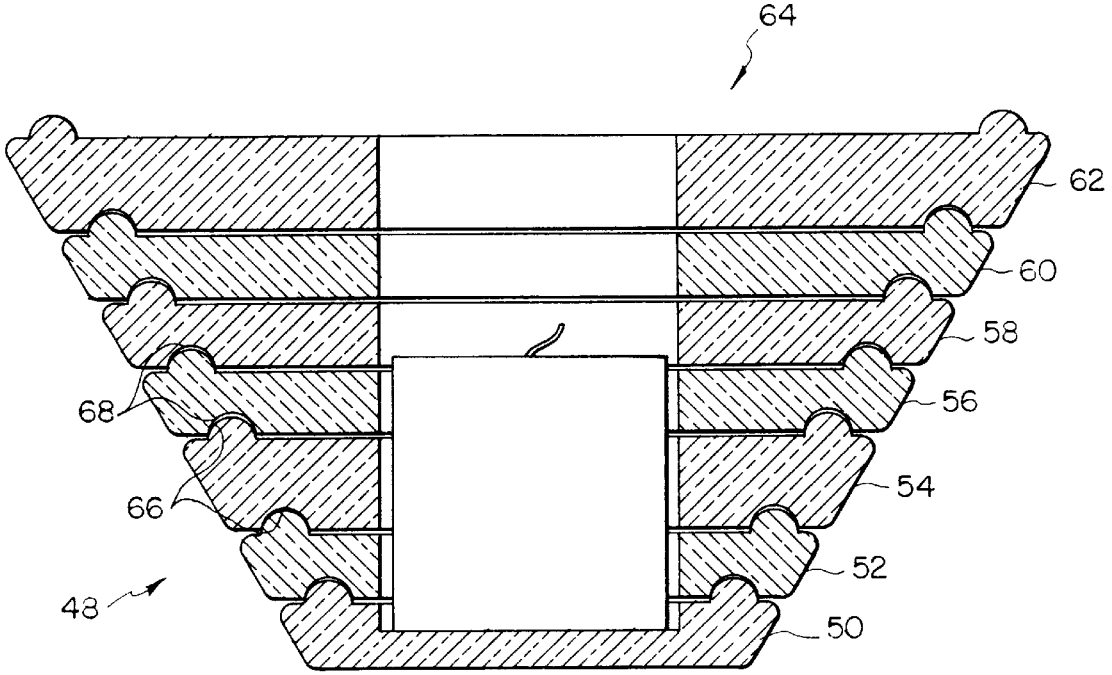
FIG. 6 is a vertical sectional view through yet another embodiment of the present invention.

Although all layers of the previous embodiments have the same peripheral shape, in an alternate embodiment the peripheral shapes may be dissimilar, as shown for example in FIG. 6. Base 50 supports a body portion 48 which consists of six layers 52, 54, 56, 58, 60 and 62. Layers 52, 56, 58 and 60 are of one thickness, while layers 54 and 62 are of a second thickness. Additional thicknesses, of course, may be provided is desired. Further, the various layers may be provided in different colors, if desired. Each of the layers 52–62 includes a central aperture 64 to receive the votive candle 30.

Provided near the edges of each layer are a ridge 66 and grooves 68 by means of which the various layers of body 48 may be stacked one on top of the other. Due to the dissimilar peripheral shapes of the various layers, with this arrangement, each layer needs to be stacked in a certain order to fit properly. However, it may be appreciated that the undersides of the layers may be provided, if desired, with additional grooves to accommodate a more random stacking of the various layers.

Obviously, numerous modifications and variations of the present invention are possible in light of the above teachings. It is therefore to be understood that within the scope of the appended claims, the invention may be practiced otherwise than as specifically described herein.

I claim as my invention:

1. A candle holder, which comprises:

a base having means for holding a candle; and a plurality of layers of glass stacked on said base, each of said layers including as aperture formed therein for accommodating the candle therewithin, wherein said aperture is larger than said candle so that said candle does not touch said aperture.

2. The candle holder as set forth in claim 1, wherein said plurality of layers of glass have substantially the same peripheral shape.

3. The candle holder as set forth in claim 1, wherein said plurality of layers of glass have different peripheral shapes.

4. The candle holder as set forth in claim 1, wherein said plurality of layers of glass are of more than one thickness.

5. The candle holder as set forth in claim 1, wherein said plurality of layers of glass are of more than one color.

6. The candle holder as set forth in claim 5, wherein said plurality of layers of glass each are of a color selected from the group consisting of clear white, frosted white, clear blue, frosted blue and cobalt blue.

7. The candle holder as set forth in claim 1, wherein the outer periphery of said layers of glass is square.

8. The candle holder as set forth in claim 1, wherein the outer periphery of said layers of glass is oval.

9. The candle holder as set forth in claim 1, wherein each of said outer layers of glass further comprises means for positioning each layer on top of another layer.

10. The candle holder as set forth in claim 9, wherein said positioning means comprises a ridge formed on one surface of each of said layers and a groove formed on the other surface of each of said layers.

11. The candle holder as set forth in claim 9, wherein said positioning means comprises a ball formed on one surface of each of said layers and a socket formed on the other surface of each of said layers.

12. A candle holder, which comprises:

a base having means for holding a candle;

a plurality of layers of glass stacked on said base, each of said layers including an aperture formed therein for accommodating the candle therewithin, wherein said base has an outline similar to the outline of said layers, and further includes layer positioning means formed thereon for receiving one of said layers on top thereof.

13. The candle holder as set forth in claim 12, wherein said means for holding a candle comprises a solid bottom portion for said base.

14. The candle holder as set forth in claim 13, wherein said apertures of said plurality of layers are positioned over said solid bottom portion of said base during use.

15. A holder for a single candle, which comprises:

a base member made of glass and having a central portion adapted to hold a candle therein; and a plurality of individual, movable glass layers stacked on top of said base member, said plurality of glass layers including layers of different colors, wherein said plurality of glass layers include an aperture formed therethrough for allowing a candle to be positioned therewithin, said aperture being larger than said candle so that said candle does not touch said aperture.

16. The holder for a single candle as set forth in claim 15, wherein said plurality of glass layers includes layers of different thicknesses.

17. The holder for a single candle as set forth in claim 15, wherein said plurality of glass layers includes layers of different peripheral shapes.

18. The holder for a single candle as set forth in claim 15, wherein said plurality of glass layers all have substantially the same peripheral shape.

19. A holder for a candle, which comprises:

a base member and having a central portion adapted to hold a candle therein; and a plurality of glass layers stacked on top of said base member, said plurality of glass layers including layers of different thicknesses, each of said layers including a central aperture larger than said candle for fitting about said candle without touching said candle.

* * * * *